US011608689B2

(12) United States Patent
Zhan et al.

(10) Patent No.: US 11,608,689 B2
(45) Date of Patent: Mar. 21, 2023

(54) ROTATABLE MULTI-HEAD BALL BITS

(71) Applicant: SAUDI ARABIAN OIL COMPANY, Dhahran (SA)

(72) Inventors: Guodong (David) Zhan, Dhahran (SA); Bodong Li, Dhahran (SA); Chinthaka P. Gooneratne, Dhahran (SA); Timothy Eric Moellendick, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/991,630

(22) Filed: Aug. 12, 2020

(65) Prior Publication Data

US 2022/0049555 A1 Feb. 17, 2022

(51) Int. Cl.
*E21B 10/16* (2006.01)
*E21B 10/52* (2006.01)

(52) U.S. Cl.
CPC ..... *E21B 10/16* (2013.01); *E21B 10/52* (2013.01)

(58) Field of Classification Search
CPC ..... E21B 10/64; E21B 10/66
USPC ..... 175/383
See application file for complete search history.

(56) References Cited

U.S. PATENT DOCUMENTS 3,847,236 A * 11/1974 Coalson ..... E21B 10/20 175/383
7,571,782 B2 8/2009 Hall et al.
10,731,420 B2 * 8/2020 Dahlgren ..... E21B 10/08
2009/0223718 A1 9/2009 Tibbitts
2015/0047905 A1 * 2/2015 Clark ..... E21B 10/627 175/57
2016/0237752 A1 8/2016 Jones
2018/0087323 A1 * 3/2018 Dahlgren ..... E21B 23/004
2020/0095831 A1 3/2020 Etebu et al.

FOREIGN PATENT DOCUMENTS

CN 104847274 A 8/2015

OTHER PUBLICATIONS

International Search Report and Written Opinion of the International Searching Authority issued in corresponding International Application No. PCT/US2020/058150, dated May 7, 2021 (14 pages).

* cited by examiner

*Primary Examiner* — Cathleen R Hutchins
(74) *Attorney, Agent, or Firm* — Osha Bergman Watanabe & Burton LLP

(57) ABSTRACT

A drill bit having a rotatable ball bit includes a first bit head and a second bit head, a first set of cutters on the first bit head, and a second set of cutters on the second bit head. The rotatable ball bit is configured to rotate between a first position and a second position, wherein the first bit head is distal to the second bit head in the first position, and wherein the second bit head is distal to the first bit head in the second position. A method of operating a rotatable ball bit includes orienting the rotatable ball bit in a first position, wherein a first bit head is oriented distally, rotating the rotatable ball bit about a longitudinal axis, orienting the rotatable ball bit in a second position, wherein a second bit head is oriented distally, and rotating the rotatable ball bit about the longitudinal axis.

13 Claims, 5 Drawing Sheets

ROTATABLE MULTI-HEAD BALL BITS

BACKGROUND OF INVENTION

Field of the Invention

The invention relates generally to drill bits and methods for operating drill bits to drill a wellbore.

Background Art

Modern oil and gas drilling operations take place in highly challenging environments. Hard rock formations, vibrations, high temperatures, and high pressures encountered during drilling of a wellbore slow down the drilling process significantly. Additionally, hard rock formations can quickly wear through drill bits, resulting in an increased frequency of replacing the worn drill bit through a process called "tripping the bit." Tripping the bit includes pulling the bit to the surface through thousands of feet of wellbore by extracting and disassembling the many sequential sections of drillstring to which the drill bit is coupled. During this drillstring removal process, which can last for tens of hours depending on the length of the wellbore at the time of bit replacement, no further drilling can occur. Thus, while replacing the worn drill bit may be necessary to complete drilling of a wellbore, the replacement process is comes at the expense of lengthy periods of non-production.

SUMMARY OF INVENTION

A drill bit having a rotatable ball bit includes a first bit head and a second bit head, a first set of cutters disposed on the first bit head, and a second set of cutters disposed on the second bit head. The rotatable ball bit is configured to rotate between a first position and a second position, wherein the first bit head is distal to the second bit head in the first position, and wherein the second bit head is distal to the first bit head in the second position.

A method of operating a rotatable ball bit includes orienting the rotatable ball bit in a first position, wherein a first bit head is oriented distally, rotating the rotatable ball bit about a longitudinal axis, orienting the rotatable ball bit in a second position, wherein a second bit head is oriented distally, and rotating the rotatable ball bit about the longitudinal axis.

Other aspects and advantages of the invention will be apparent from the following description and the appended claims.

DETAILED DESCRIPTION

In order to minimize the number of bit trips during drilling of a wellbore, there is a need to extend bit life, particularly when drilling through hard formation. In particular, very hard, abrasive, and interbedded formations having an unconfined compressive strength (UCS) around 35,000 psi require new solutions to improve drilling efficiency.

Figure 1:
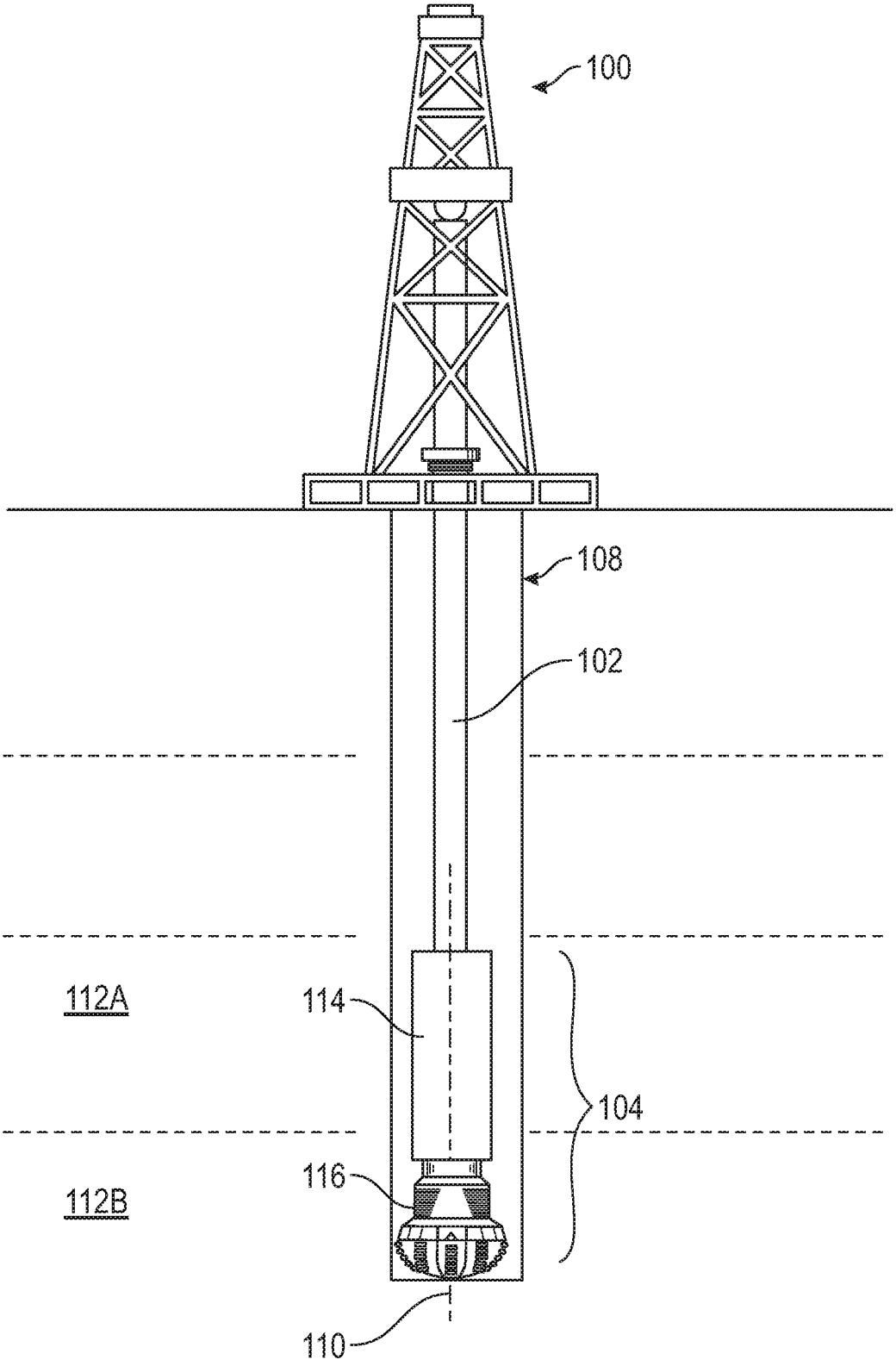
FIG. 1 is a schematic representation of a wellbore drilling system.

Referring to FIG. 1, an example drilling rig 100 is shown. The drilling rig 100 includes a drill string 102 connected to a bottom hole assembly 104 which includes a drill bit 106. In addition to the drill bit 106, the bottom hole assembly may include several other components such as a bit sub, stabilizer, drill collar, jarring device, mud motor, logging-while-drilling equipment, measurements-while-drilling equipment, and other tools represented by box 114, depending on the planned profile of the wellbore and the type of formation the bit will carve through.

The weight of the bottom hole assembly presses the drill bit into the formation during drilling; this is referred to as "weight on bit." The weight on bit generates force between the bit and the formation to help cutting elements on the bit engage with and remove formation to create the wellbore 108 while still allowing the bit to rotate about a longitudinal axis 110. The weight on bit affects a rate at which the drill bit 106 moves through formation 112, referred to as the "rate of penetration" (ROP). Rate of penetration may also be used as an indicator of bit performance. High ROP may indicate that the drill bit is digging efficiently through formation while a low ROP may indicate that the drill bit is performing poorly, either because the drill bit is worn out or because it has encountered a layer of particularly hard formation. For example, as the drill bit 106 encounters soft formation layer 112*a*, the bit can move at a ROP of more than 340 feet per hour; when digging through particularly hard formation, such as formation layer 112*b*, ROP can drop to less than 10 feet per hour. A low ROP may indicate to an operator that it is necessary to trip the bit for replacement with a new bit of the same type or with a different type of bit better suited to drill through the formation layer.

There are several types of drill bits, each designed to for a specific drilling environment. For example, roller-cone bits crush and chip away chunks of formation, hammer bits act to impact and break formation, and drag bits, such as polycrystalline diamond compact (PDC) bits, scrape and shear rock, especially in shale formations. One metric for evaluating bit performance in an environment is the distance a bit is able to drill before the bit wears out, referred to as "bit footage." For soft formation, bit footage may be as high as 16,000 feet while in hard formation, bit footage may be as low as 300 feet. For wells requiring thousands of feet of drilling, a low bit footage necessitates many bit trips and bit replacements. Thus, using bits that have low bit footage in a given drilling environment may add to the overall time and cost of drilling the wellbore.

One factor that contributes to low bit footage is vibration. Drilling through hard, abrasive formation may cause the bit to skip across the formation rather than engaging with and removing rock. Such interaction between the bit and formation causes vibration and exposes the drill bit to high impact forces which quickly degrade components of the bit, such as cutting elements. Inconsistent contact between the bit and the formation may also limit the bit's ability to engage and remove rock to form the wellbore.

The high pressure, high temperature environment encountered during drilling can also degrade bit life. As a result, drill bit components may be formed from one or more materials known to withstand such extreme conditions. For example, many bits are formed from hardened steel, polycrystalline diamond compact, and tungsten carbide. Bit designs have been limited to shapes achievable with traditional fabrication methods for these materials. However, advancements in fabrication techniques, particularly additive manufacturing techniques such as laser sintering and electron beam melting, have enabled fabrication of new bit geometries. Such fabrication methods also facilitate integration of sensors and embedded components within the bit as will be discussed in further detail below.

Several variables such as bit wear, vibration, or use of a bit not suited for a particular drilling environment may contribute to poor bit performance. Additional factors, such as weight on bit, drilling fluid composition, and drilling fluid flow rate through the bit, must also be selected to optimize drilling performance. A drilling operator is responsible for understanding and optimizing each of these many factors to maximize drilling efficiency and minimize drilling time and cost.

Several configurations of a rotatable multi-head ball bit are disclosed herein which include features for extending bit life, improving rate of penetration, and providing real-time data to drilling operators. Thus, embodiments herein may contribute to more informed decision making and may reduce the number of bit trips and overall time associated with drilling a well.

Figure 2:
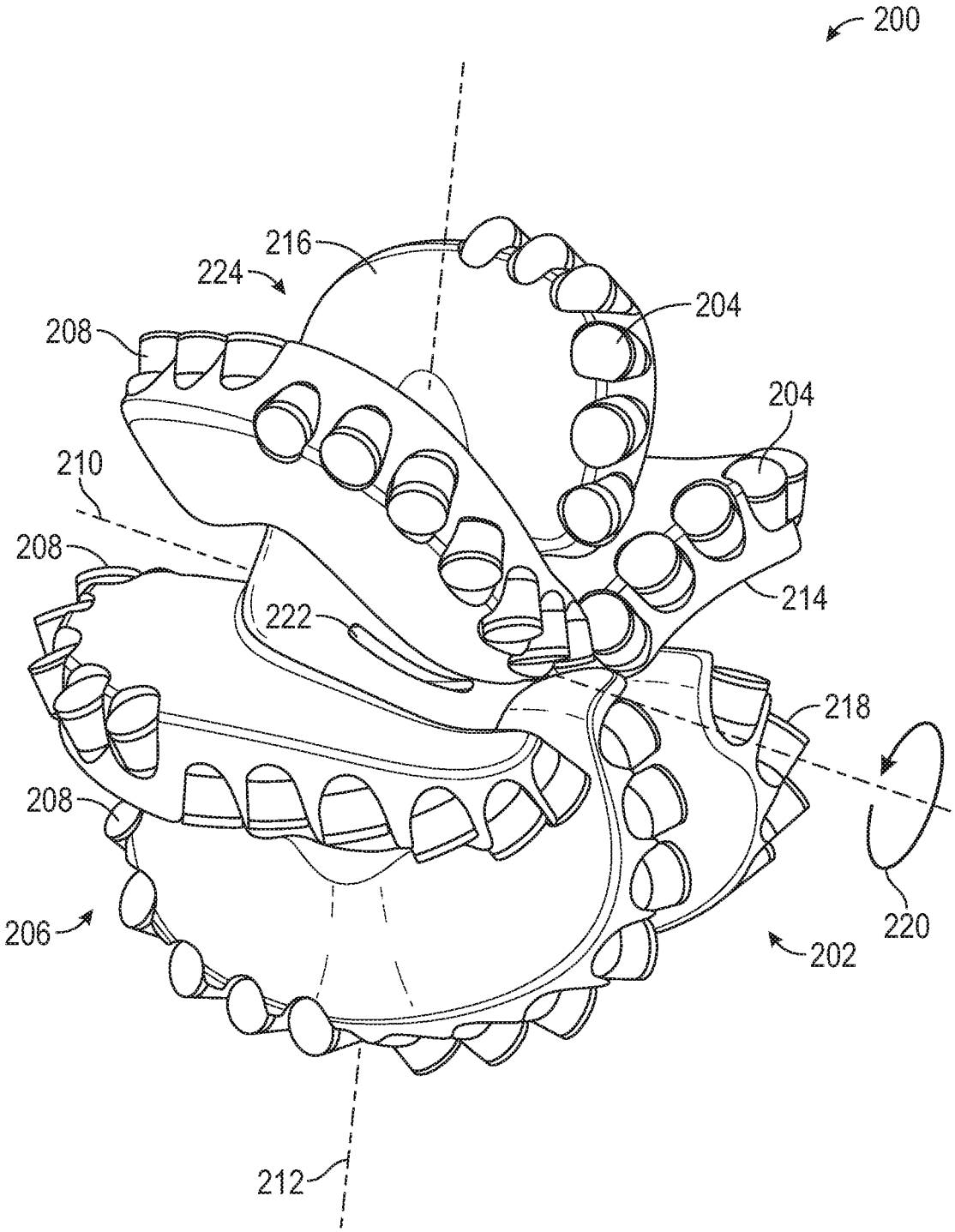
FIG. 2 is a perspective views of a multi-head ball drill bit according to one or more embodiments disclosed herein.

Referring to FIG. 2, an example of a rotatable multi-head ball drill bit is shown. The ball drill bit 200 includes a first bit head 202 with a first set of ridges 214 having a first set of cutters 204 disposed thereon and a second bit head 206 with a second set of ridges 216 having a second set of cutters 208 disposed thereon. The first and second sets of cutters 204, 208 may be mounted on the first and second set of ridges 214, 216, respectively, such that cutting faces 218 on the set of cutters oriented distally are angled to engage formation when the drill bit is rotated about the longitudinal axis 210. For example, in FIG. 2, the first set of cutters 204 is oriented distally and the first set of cutters are angled such that cutting faces 218 thereof engage formation when the drill bit 200 rotates about longitudinal axis 210 in a drilling direction 220. The first set of ridges 214 may be connected with the second set of ridges 216 as shown; alternatively, the two sets of ridges may be separated by a gap.

The bit 200 may further include a drilling fluid outlet 222 through which drilling fluid may exit the bit 200 from an internal channel (not shown) to flush formation debris away from the active cutting elements. The drilling fluid outlet 222 may be a circle, oval, elongated slot, or any other shape designed to deliver fluid to a distal portion of the drill bit at a selected flow rate and location. More than one drilling fluid outlet may be integrated into the bit 200. The fluid leaves the drill bit through the drilling fluid outlet 222 and collects formation debris. The debris-laden fluid circulates upward past the bit 200 through recesses 224 disposed between the ridges. The recesses 224 may be rotationally symmetric about the longitudinal axis 210.

In some embodiments, the first bit head 202 and the second bit head 206 include substantially the same arrangement of features. For example, the first bit head 202 and the second bit head 206 may include the same number, shape, placement, and orientation of ridges, recesses, cutting elements and drilling fluid outlets. In other embodiments, the first bit head 202 and the second bit head 206 can include different arrangements of the various features. In such configurations, a single bit includes a variety of bit heads, each of which may include an arrangement of features optimized for drilling in different conditions.

The drill bit 200 may move into a first position such that the first bit head 202 is oriented distally within a wellbore. In the first position, rotation of the bit 200 about a longitudinal axis 210 causes the first set of cutters 204 to engage the rock formation. The second bit head 206 and second set of cutters 208 may be oriented to face proximally toward the drill string such that they do not contact or only minimally contact the formation. Thus, in the first position, the first bit head 202 is an active bit head while the second bit head 206 is a reserve bit head.

The drill bit 200 may be moved into a second position such that the second bit head 206 is oriented distally and the second set of cutters 208 contact and drill through formation when the drill bit is rotated about the longitudinal axis 210. In the second position, the first bit head 202 and the first set of cutters 204 are oriented to face proximally toward the drill string so that they do not contact or only minimally contact the formation. In this second position, the second bit head 206 is the active bit head while the first bit head 202 is the reserve bit head. Moving the rotatable ball drill bit 200 between first and second positions may include rotating the drill bit 200 approximately 180 degrees about a transverse axis 212. The transverse axis 212 may be substantially perpendicular to the longitudinal axis 210 and may pass through a center of rotation of the drill bit 200. In some embodiments, a locking mechanism may be included on the drill bit 200 to control rotation about the transverse axis 212. A mechanical or hydraulic locking mechanism can be implemented.

Figure 3:
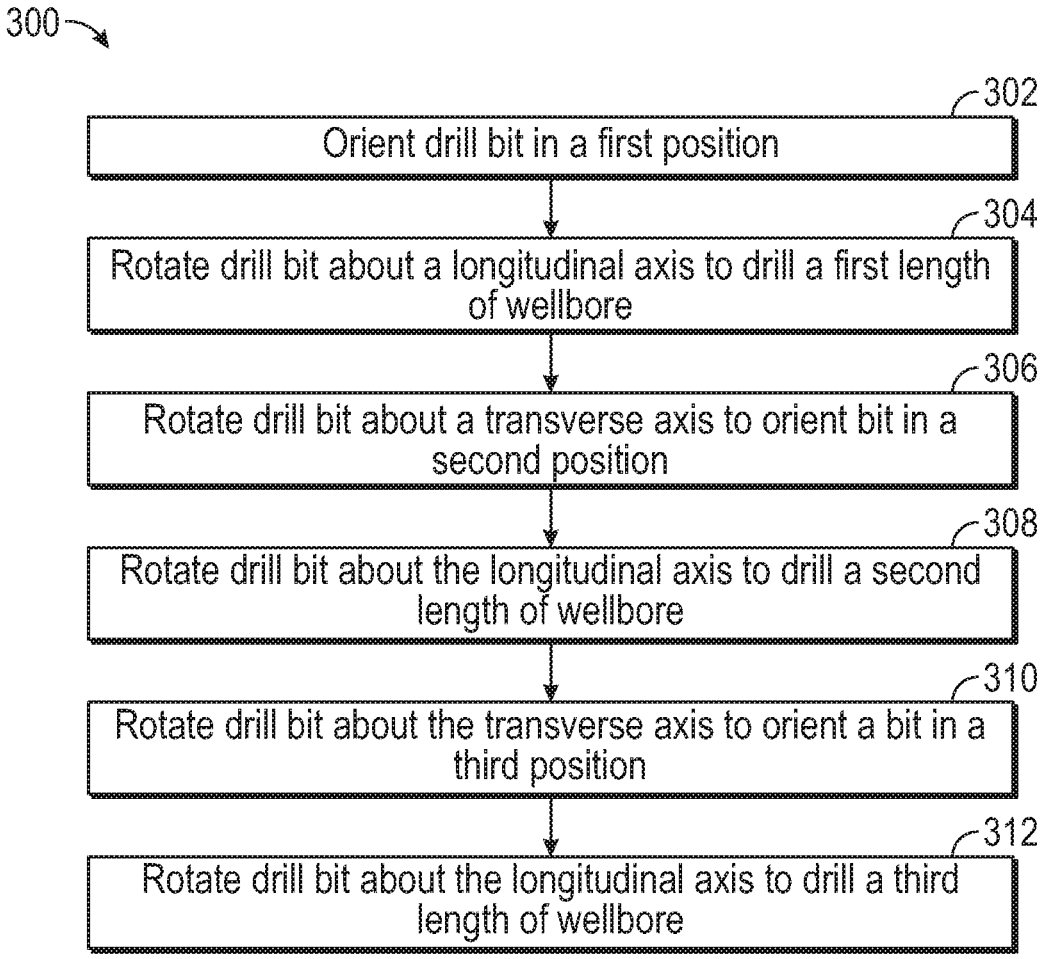
FIG. 3 is a block diagram showing steps for operating a multi-head ball drill bit according to one or more embodiments disclosed herein.

Referring to FIG. 3, a process flow diagram for operating the drill bit 200 is shown. The drill bit is oriented in a first position at step 302 where the drill bit is rotated about a longitudinal axis to drill a first length of wellbore at step 304. The drill bit can be rotated about a transverse axis to orient the bit in a second position at step 306 and rotated about the longitudinal axis to drill a second length of wellbore at step 308. The drill bit position can again be rotated about the transverse axis to orient the bit in a third position at step 310 where the drill bit is again rotated about the longitudinal axis to drill a third length of wellbore at step 312. In some embodiments, the third position is different from the first and second positions. Alternatively, the third position may be substantially the same as the first position. The drill bit can be rotated alternatingly between any one of the multiple positions for optimal drilling.

In some embodiments, the drill bit is oriented in the first position until the first bit head 202 including the first set of cutters 204 is worn out. A drilling operator may determine that the first bit head is worn out due to a drop in rate of penetration. In response, the drill bit 200 may be rotated into the second position where the second bit head 206 and second set of cutters 208 take over drilling the wellbore. Additional bit heads and sets of cutting elements can be included on the drill bit for added longevity of the drill bit. Thus, instead of tripping the drill bit when the first bit head is worn, additional bit heads can be subsequently used to continue drilling with fresh cutting elements.

Alternatively, the drill bit 200 may be cycled through two or more positions intermittently. For example, the first bit head 202 may drill for an amount of time or for a length of bit footage before rotating the drill bit 200 to use the second bit head 206. From the second position, the bit can be oriented to the third position, which may be the same or a different position compared to the first position, where drilling for a period of time or for a stretch of bit footage may continue. Such a method of operation may spread wear evenly across all cutting elements on the bit and may reduce cutting element degradation due to prolonged exposure to the high vibrations, temperatures, and pressures involved with active drilling.

Figure 4:
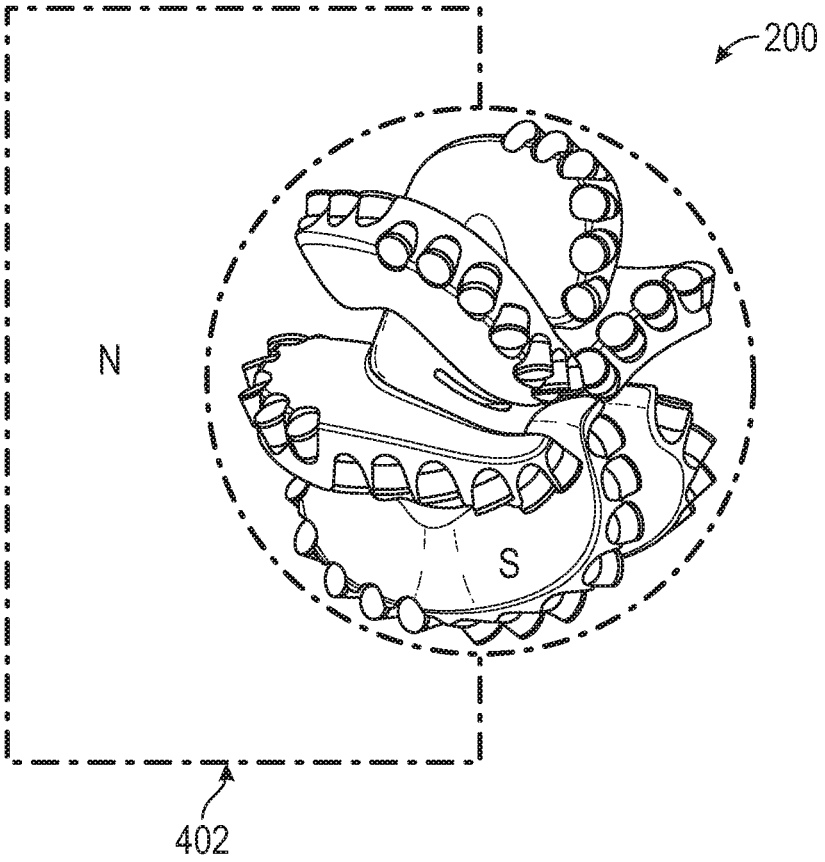
FIG. 4 is a schematic representation of a magnetic actuation mechanism according to one or more embodiments disclosed herein.

Rotation about the transverse axis may be driven by one or more actuation mechanisms. Referring to FIG. 4, a schematic for a magnetic actuation means is shown. The rotatable ball drill bit 200 includes a magnetic actuation system 402. The magnetic actuation system 402 can include a south pole embedded within the body of rotatable drill bit 200 and a north pole located near the drill bit. For example, the north pole may be located in a nearby drill bit sub or motor. Actuation of the system can be controlled using electrical sensors or RFID.

Other actuation mechanisms can be used instead of or in addition to the magnetic actuation system 402. For example, mechanical, hydraulic, or electrical control systems may be used to change the position of the bit 200. A mechanical control system may include one or more gears driven by a motor to cause rotation of the bit 200 about the transverse axis. A hydraulic control system may include a ball drop mechanism to alter pressure within one or more downhole tools operatively coupled with the drill bit to cause rotation of the bit about the transverse axis.

Figure 5:
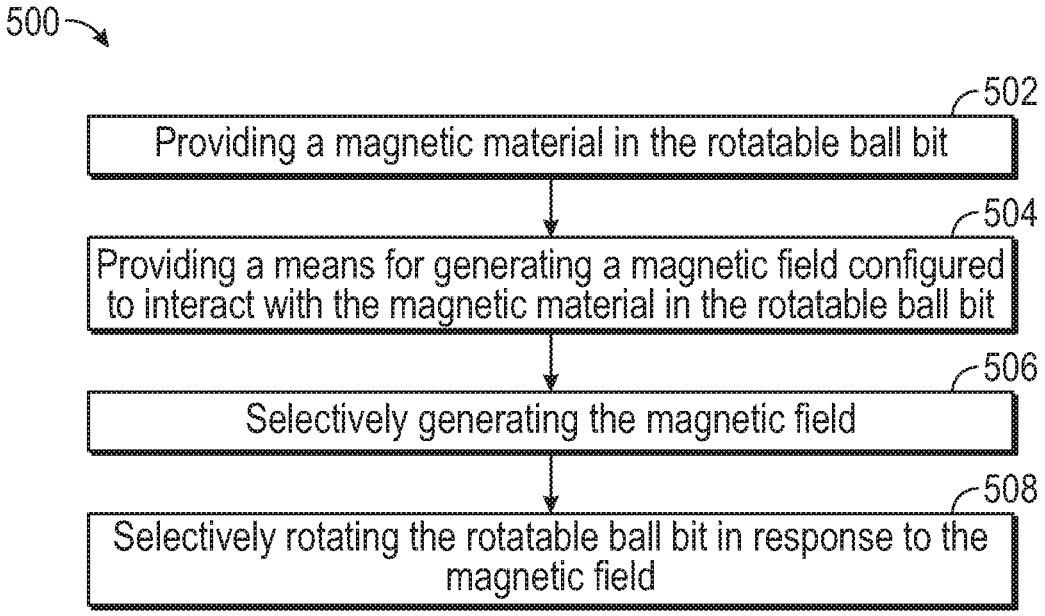
FIG. 5 is a block diagram showing steps for driving an actuation mechanism according to one or more embodiments disclosed herein.

FIG. 5 shows a process flow diagram for actuating rotation of the drill bit 200 about the transverse axis. The process 500 includes providing a magnetic material in the rotatable drill bit at step 502. Step 504 includes providing a means for generating a magnetic field which can interact with the magnetic material in the rotatable ball bit. Step 506 includes selectively generating the magnetic field. The selectively generated magnetic field in turn selectively rotates the rotatable ball bit at Step 508.

Figure 6:
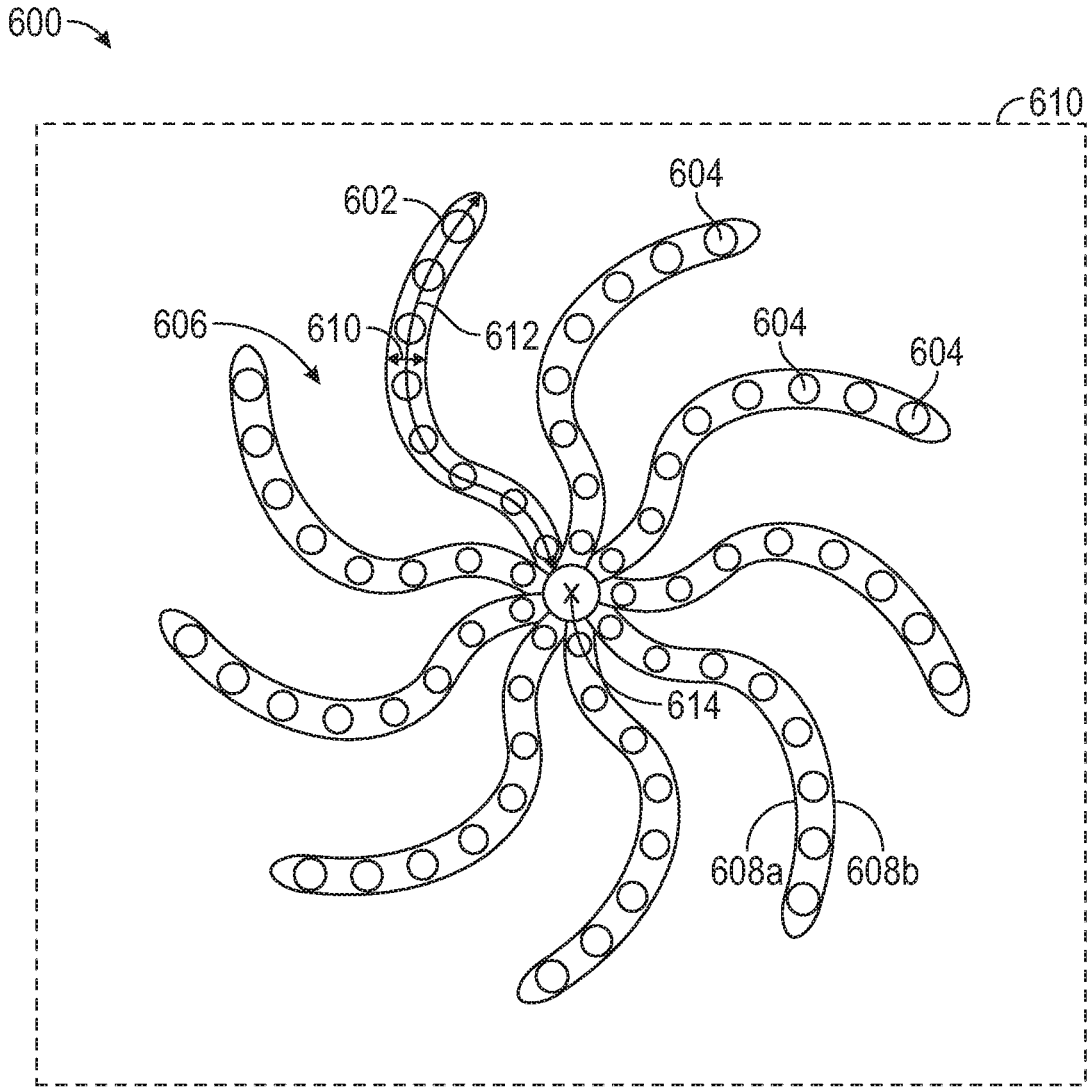
FIG. 6 is a top-down view of a bit head pattern according to one or more embodiments disclosed herein.

Referring to FIG. 6, a bit head pattern 600 is shown in a top-down view. The bit head pattern 600 can be implemented on a multi-head ball bit. The pattern 600 includes multiple ridges 602, each having a plurality of cutting elements 604 disposed thereon. In some embodiments, each ridge 602 may include between five and ten or between ten and fifteen cutting elements 604. The cutting elements 604 may be PDC cutters and may be angled such that cutting faces thereof face toward formation when the bit is rotated about a longitudinal axis 614 (out of the page). The ridges 602 are separated by recesses 606 that may facilitate the flow of drilling fluid and formation cuttings therethrough. The ridges 602 are defined by side walls 608*a*, 608*b* that include curvature in the transverse plane 610. In some embodiments, the side walls 608*a*, 608*b* of each ridge 602 include substantially the same curvature and are substantially parallel. In such configurations, a thickness 610 of the ridge 602 is substantially constant across at least a portion of its length 612. The curve governing the side walls 608*a*, 608*b* includes a single inflection point in the transverse plane to create a generally s-shaped ridge 602; however other configurations having more or fewer inflection points are possible. Bit head pattern 600 is shown having nine ridges that are rotationally symmetric about the longitudinal axis 614; however, more or fewer ridges can be included on the bit head. For example, for hard or abrasive formation, more ridges and increased cutter density may improve drilling efficiency. A multi-head rotatable ball bit may be formed by replicating the bit head pattern 600 over two or more regions of the ball bit to create two or more bit heads. Alternatively, a plurality of slightly different variations of bit head pattern 600 (for example, patterns including more or fewer ridges, recesses, and cutting elements) may be implemented on a single rotatable ball drill bit to form a multi-head ball drill bit with bit heads optimized for particular drilling conditions.

The arrangement of ridges, recesses, and cutters shown in bit head pattern 600 may facilitate improved cutter cooling and faster removal of rock cuttings and debris. Such improvements may extend the life of cutting elements and bit heads thereby reducing non-productive time associated with tripping and replacing the drill bit.

The curves, ridges, recesses, fluid channels, and cutter angles and placements of bit configurations disclosed herein are complex and may be difficult to manufacture using the machining or molding processes commonly used to form steel or tungsten carbide matrix bit bodies. Additive manufacturing processes such as electron beam melting, selective laser melting, and electron beam reinforced additive manufacturing can be used to fabricate the complex rotatable multi-head bit designs described herein. In some embodiments, the drill bit designs disclosed herein include a PDC matrix body with PDC cutters. To further extend life of the drill bit, the bit body and cutters may be covered with an outer coating for increased durability. The coating may be a nanocoating applied using coating processes such as atomic layer deposition. The coating material that can be coated on the bit body surface can include ceramics, such as $Al_2O_3$, $ZrO_2$, and SiC, or hard materials such as TiB, BN, and diamond-like carbon. The coating layer thickness can range from a few microns to several microns. For example, from approximately two microns to approximately 100 microns. For coatings that are bit body starting powder coatings, coating layer thickness can range from a few nanometers to several microns. For example, from approximately two nanometers to approximately 10 microns.

In addition to facilitating the fabrication of complex designs, additive manufacturing enables fabricating a drill bit with more than one material. For example, the bit can include one or more pockets of magnetic material embedded within the PDC matrix body. As discussed above, the magnetic material may interact with a magnetic field generated elsewhere on the bit or on the bottom hole assembly to actuate rotation of the drill bit.

During fabrication, channels or cavities may be formed within the body of the rotatable multi-head ball bit. Such channels may pass entirely through the drill bit to allow drilling fluid to flow to a bit head actively involved with drilling the wellbore. Alternatively, cavities may partially or fully encapsulate sensor equipment such as nano-logging devices, infrared (IR) temperature sensors, transceivers, and gas sensing systems. One or more of these sensing components may be additionally or alternatively integrated into one or more of the cutting elements. The sensing components may be configured to store data or transmit data in substantially real time to a drilling operator. The drilling operator may use information from the sensing components to evaluate one or more of the drill bit condition, the drilling environment, and the formation condition. Such real-time information may assist in determining whether or not a drill bit requires replacement. In some embodiments, the sensing equipment may provide data to an automated drilling system configured to control one or more aspects of the drilling operation.

While various configurations of rotatable multi-head ball drill bits have been described with respect to a limited number of embodiments, those skilled in the art, having benefit of this disclosure, will appreciate that other embodiments can be devised which do not depart from the scope of the present disclosure. Accordingly, the scope of the disclosure should be limited only by the attached claims.

The invention claimed is:

1. An apparatus comprising:

a ball drill bit comprising a first bit head and a second bit head, wherein the first bit head and the second bit head form the ball drill bit in a shape of a sphere;

a first set of ridges having a first set of cutters, wherein each of the first set of cutters have a first cutting face disposed thereon, wherein the first set of ridges are disposed on the first bit head;

a second set of ridges having a second set of cutters, wherein each of the second set of cutters have a second cutting face, disposed thereon, wherein the second set of ridges are disposed on the second bit head, wherein the first set of ridges and the second set of ridges extend circumferentially around the sphere such that the first set of ridges and the second set of ridges are located completely around the sphere, wherein the first set of cutters and the second set of cutters are mounted on the first set of ridges and the second set of ridges, respectively, such that the cutting faces of each set of cutters are oriented distally and angled such that the cutting faces thereof engage a formation, wherein, in a first position defined by an orientation of the first bit head and the second bit head, the first bit head is oriented away from a drill string and towards the formation while the second bit head is oriented to face towards the drill string, wherein, in a second position defined by the orientation of the first bit head and the second bit head, the second bit head is oriented away from the drill string and towards the formation while the first bit head is oriented to face towards the drill string; and a magnetic field generator configured to generate a magnetic field around the ball drill bit, wherein the magnetic field is manipulated to move the ball drill bit between the first position and the second position.

2. The apparatus of claim 1, wherein an arrangement of the first set of ridges is substantially the same as an arrangement of the second set of ridges.

3. The apparatus of claim 2, wherein an arrangement of the first set of cutters is substantially the same as an arrangement of the second set of cutters.

4. The apparatus of claim 1, wherein at least one ridge of the first set of ridges comprises a curved side wall.

5. The apparatus of claim 4, wherein the curved side wall comprises an s-shape.

6. The apparatus of claim 1, wherein the first set of cutters comprises polycrystalline diamond compact material.

7. The apparatus of claim 1, further comprising a magnetic material disposed in the ball drill bit.

8. The apparatus of claim 1, further comprising at least one drilling fluid outlet.

9. The apparatus of claim 1, further comprising a sensor integrated into the ball drill bit.

10. The apparatus of claim 9, wherein the sensor includes at least one of a logging sensor, an infrared temperature sensor, a transceiver, or a gas sensor.

11. A method comprising:

providing a ball drill bit, the ball drill bit comprising:

a first bit head and a second bit head, wherein the first bit head and the second bit head form the ball drill bit in a shape of a sphere;

a first set of ridges having a first set of cutters, each having a cutting face, disposed thereon, wherein the first set of ridges are disposed on the first bit head;

a second set of ridges having a second set of cutters, each having the cutting face, disposed thereon, wherein the first set of ridges are disposed on the second bit head, a first position defined by an orientation of the first bit head and the second bit head, wherein the first bit head is oriented away from a drill string and toward a formation while the second bit head is oriented to face toward the drill string; and a second position defined by the orientation of the first bit head and the second bit head, wherein the second bit head is oriented away from the drill string and toward the formation to be drilled while the first bit head oriented to face toward the drill string;

placing the ball drill bit near a magnetic field generator;

activating the magnetic field generator to expose the ball drill bit to a magnetic field; and moving the ball drill bit between the first position and the second position by manipulating the magnetic field using the magnetic field generator.

12. The method of claim 11, further comprising:

collecting data from a sensor disposed on the ball drill bit; and transmitting the data to a drilling operator.

13. The method of claim 12, further comprising adjusting a drilling parameter selected from a group comprising a ball drill bit position and a drilling fluid flow rate based on the data.

* * * * *